United States Patent [19]

Arias

[11] Patent Number: 4,823,962

[45] Date of Patent: Apr. 25, 1989

[54] SHOE DISPLAY AND STORAGE HANGER

[76] Inventor: Juan C. Arias, P.O. Box 13364 Santurce Station, Santurce, P.R. 00908

[21] Appl. No.: 103,653

[22] Filed: Oct. 2, 1987

[51] Int. Cl.[4] ..... A47F 7/08

[52] U.S. Cl. ..... 211/34; 211/113

[58] Field of Search ..... 211/34, 113; 248/339, 248/340; 223/87, 85

[56] References Cited

U.S. PATENT DOCUMENTS

| | | | |
|---|---|---|---|
| 1,270,811 | 7/1918 | Garant | 211/34 |
| 1,310,281 | 7/1919 | Clark | 211/34 |
| 3,310,272 | 3/1967 | Brunger | 211/113 X |
| 3,480,989 | 12/1969 | Edeus | 49/372 X |
| 3,592,343 | 7/1971 | Swett et al. | 211/113 X |
| 4,023,762 | 5/1977 | Batts et al. | 211/113 X |
| 4,072,179 | 2/1978 | Naito | 160/202 X |
| 4,114,674 | 9/1978 | Gabry | 160/202 X |
| 4,375,876 | 3/1983 | Stewart | 160/201 X |
| 4,453,655 | 6/1984 | Smilow et al. | 211/113 X |
| 4,597,549 | 7/1986 | Ryan | 160/37 X |

*Primary Examiner*—Robert W. Gibson, Jr.
*Attorney, Agent, or Firm*—J. Sanchelima

[57] ABSTRACT

A display and storage hangers for shoes adapted to be hung on rods that extend outwardly and substantially horizontally from the display walls where the rods are perpendicularly mounted. The hangers include an elongated member that is vertically hung from the rods. The hanger includes a vertically extending elongated member with a U-shape member integrally formed on the lower end of the elongated member. The U-shape member includes two upwardly extending tongue members that support the shoes being displayed.

8 Claims, 1 Drawing Sheet

SHOE DISPLAY AND STORAGE HANGER

BACKGROUND OF THE INVENTION

1. Field of the Invention

The present invention relates to display and storage hangers for shoes.

2. Description of the Related Art

The need for devices to display shoes in a retail establishment is quite obvious. The attempts to provide for such devices have taken into consideration the high cost of real estate space. All products complete for display space and the retailer is constantly changing its allocation of display space in response to its profit expectation from the products and the amount of space required. Another consideration in designing shoe displays involves the exposure provided to the retailer's inventory as the shoes are removed by the shoppers.

Applicant believes that the closest reference corresponds to U.S. Pat. No. 3,635,353 issued to Matsubara on Jan. 18, 1972. However, it differs from the present invention because it includes a bulky base sheet 2 and fastening strings 5 which require more time to mount and remove the footwear products from Matsubara's holder. Also, it is not clear how Matsubara's holder would work for more conventional shoes instead of the sandals shown in the patent drawings, without damaging the shoe itself.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a display and storage hanger for shoes that utilize a minimum of display space while at the same time displays most of the features of the shoe.

It is another object of this present invention to provide such a display and a storage hanger for shoes that utilize a minimum number of parts and that provides for readily mounting and removing the shoes being displayed.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
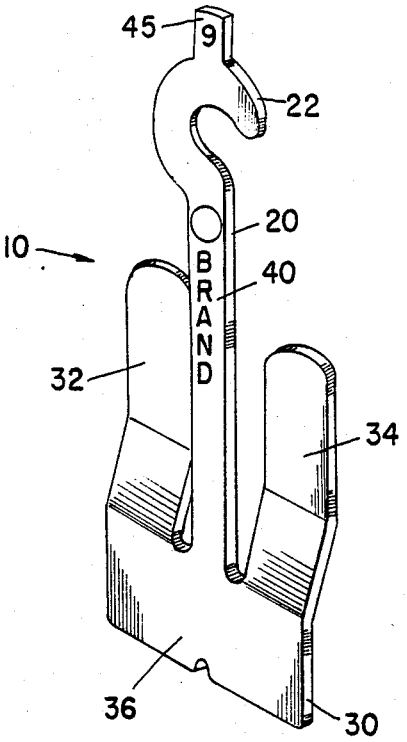
FIG. 1 represents a view in perspective of a preferred embodiment according to the present invention.

Referring now to FIG. 1, where the present invention is generally referred to with numeral 10, it can be observed that it basically includes a vertically extending elongated and flat member 20 which is provided with a hook termination 22 that is preferably integrally built on the upper end of member 20 and adapted to be hung from a rod (not shown) that runs substantially horizontally and perpendicular to the display walls. The rods are slightly raised on the end that is farther away from the display wall where they are mounted to insure that hangers 10 do not fall off. A U-shape member 30 is preferably built on the lower end of member 20 and includes tongue members 32 and 34 that extend upwardly and substantially parallel to member 20 in a space apart relationship with the latter.

Figure 2:
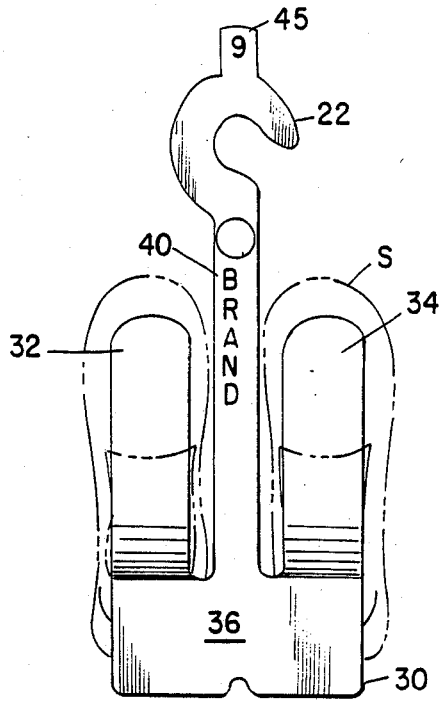
FIG. 2 shows a front view of the hanger shown in FIG. 1.
Figure 3:
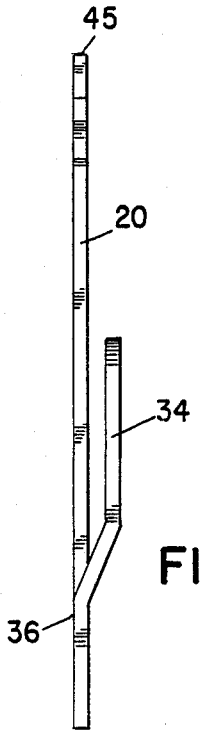
FIG. 3 illustrates a side view of the hanger represented in FIGS. 1 and 2.
Figure 4:
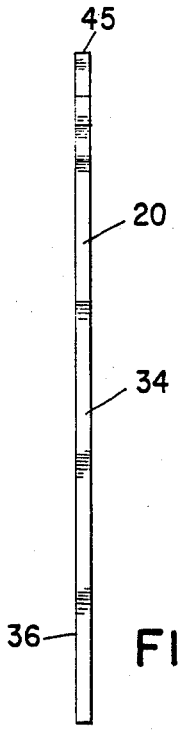
FIG. 4 is a representation of another embodiment in accordance with the present invention.

Tongue members 32 and 34 are inserted inside shoe S, as shown in FIG. 2. U-shape member 30 is preferably flat and tongue member 32 and 34 may lie in the same plane as the base portion 36 of U-shape member 30, as shown in FIG. 4, or slightly separated from the plane of U-shape member 30, as shown in FIGS. 1; 2 and 3. While the embodiment of FIGS. 1 through 3 takes slightly more display space, it shows the characteristics of the shoes displayed better and also it is easier to hang and remove the shoes from the hanger.

Legends 40 may be stamped or affixed by means of tags or labels on either one of the surfaces of member 20. These legends may include the price, trademark and any other desired information. Tabs 45 are used to readily display the size of the shoes, in the preferred embodiment. Tabs 45 may either be rigidly mounted above hook termination 30 or integrally built thereon.

In FIG. 4, an alternate embodiment is shown where tongue members 32 and 34 lie in the same plane as member 20, thereby saving rack space.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A display and storage hanger for shoes for mounting on substantially horizontally extending rods, comprising:

A. an elongated member having two ends and one of said ends including hook means for mounting on said rods so that the said elongated member and said hook means define a plane that is perpendicular to said rods when mounted thereon;

B. a U-shaped member rigidly mounted to the other end of said elongated member and said U-shaped member including two tongue members that extend upwardly parallel to said elongated member and terminating at a point substantially on the center of said elongated member so that said tongue members are inserted inside said shoes for their support and wherein said tongue members are in the same plane of said elongated member.

2. The hanger set forth in claim 1 wherein said elongated member and said U-shape member are flat.

3. The hanger set forth in claim 2 wherein said elongated member includes at least one flat surface having a plurality of legends thereon.

4. The hanger set forth in claim 1 wherein said U-shape and said elongated members are flat.

5. A display and storage hanger for shoes for mounting on substantially horizontally extending rods, comprising:

A. an elongated flat member having two ends and one of said ends including flat hook means for mounting on said rods so that the plane defined by said elongated member and said hook means define a plane that is perpendicular to said rods when mounted thereon;

B. a U-shape member rigidly mounted to the other end of said elongated member and said U-shape member including two tongue members that extend upwardly parallel to said elongated member in a plane that is parallel to and at a spaced apart relationship with the plane defined by said elongated member and said hook means.

6. The hanger set forth in claim 5 wherein said U-shape member is integrally built on said elongated member and is an extension thereof.

7. The hanger set forth in claim 6 further including tab means rigidly mounted on said hook means.

8. The hanger set forth in claim 6 further including tab means integrally built on said hook means.

* * * * *